US008616667B2

(12) United States Patent
Fukasawa et al.

(10) Patent No.: US 8,616,667 B2
(45) Date of Patent: Dec. 31, 2013

(54) RECORDING APPARATUS AND RECORDING METHOD IN RECORDING APPARATUS

(75) Inventors: Jun Fukasawa, Matsumoto (JP); Takafumi Ogimura, Shiojiri (JP); Yoshikane Tsuchihashi, Shiojiri (JP); Tetsuji Yatsunami, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 220 days.

(21) Appl. No.: 13/303,082

(22) Filed: Nov. 22, 2011

(65) Prior Publication Data

US 2012/0127229 A1 May 24, 2012

(30) Foreign Application Priority Data

Nov. 24, 2010 (JP) ..... 2010-260940

(51) Int. Cl.
*B41J 29/38* (2006.01)

(52) U.S. Cl.
USPC ..... 347/14; 347/16

(58) Field of Classification Search
USPC ..... 347/14, 16, 19, 21, 101, 104, 105
See application file for complete search history.

(56) References Cited

U.S. PATENT DOCUMENTS 6,788,323 B2 * 9/2004 Enomoto et al. ..... 347/177

FOREIGN PATENT DOCUMENTS

JP 2006-036429 A 2/2006

* cited by examiner

*Primary Examiner* — Juanita D Jackson
(74) *Attorney, Agent, or Firm* — Kilpatrick Townsend & Stockton LLP

(57) ABSTRACT

In a feeding course, a first design side end position Xsn of a paper is calculated. A first side end position of the paper is detected by a paper width detector, and the detected position is set to a first side end position Xd1. When the paper is fed from an additional cassette and a paper end detection flag F1=1, an ejection starting position adjustment amount ΔX=Xd1−Xsn is set. However, when the deviation amount is not |Xd1−Xsn|≤L, the ejection starting position adjustment amount ΔX is limited to a limit value L.

7 Claims, 7 Drawing Sheets

RECORDING APPARATUS AND RECORDING METHOD IN RECORDING APPARATUS

This application claims priority to Japanese Patent Application No. 2010-260940, filed Nov. 24, 2010, the entirety of which is incorporated by reference herein.

BACKGROUND

1. Technical Field

The present invention relates to a recording apparatus on which a feeding device is detachably mounted for feeding a recording medium on a recording apparatus main body, particularly, a recording apparatus that includes a function of adjusting a limit position of a recording range of a recording unit in a width direction intersecting with a transport direction of a recording medium, and a recording method in the recording apparatus.

2. Related Art

For example, in an ink jet type serial printer, a carriage capable of being moved in a main scanning direction is included, and a paper is printed by ejecting ink droplets from nozzles of a recording head provided below the carriage while causing the carriage to reciprocate in the main scanning direction.

In the related art, an image forming device is known which includes a plurality of paper feeding portions such as a paper feeding tray accommodating a plurality of sheets of paper, or an input tray for feeding a paper other than one having the size to be accommodated in the paper feeding tray or a special paper.

For example, in JP-A-2006-36429, the size of the paper transported from a plurality of paper feeding portions such as the paper feeding tray or the input tray is detected by a size detection unit (for example, an ultraviolet sensor) provided in the carriage. The size detection unit detects the size of the recording paper on a transport path through which the recording papers transported from the respective paper feeding portions commonly pass. Furthermore, the detection result of the paper size is memorized in a memory portion in association with each paper feeding portion. For this reason, since there is no need to detect the paper size whenever the papers are transported even if the size detection units are not provided by a number of the paper feeding portion, the image forming speed does not drop. Furthermore, there is also a configuration in which, in at least one of the plurality of paper feeding portions, in order to add a paper feeding cassette to a printer, the paper feeding device is mounted on the printer main body in a detachable manner.

In this kind of serial printer, as a standard position that is based in determining a recording starting position (an ejection starting position) in the main scanning direction of the carriage upon performing the printing, a design (theoretical) side end position of the paper or a position of a predetermined distance of the design side end position is the standard position. Moreover, a position separated from the standard position by a predetermined amount, which is defined from a print setting condition concerning a layout or the like such as a margin amount of a width direction (the main scanning direction) of the paper or the presence or absence of borderless printing, is obtained as the recording starting position. In addition, the recording starting position refers to the outermost position of the main scanning direction in which the starting of the ejection of the ink droplet from the recording head is permitted, but not necessarily refers to an actual ink ejection starting position. This is because the actual ink ejection starting position depends on the print data, in the case of the pixel other than a white pixel, ink is ejected, but, ink is not ejected in the white pixel. For example, when the print data is a solid printing, the recording starting position coincides with the actual recording starting position.

However, when the additional paper feeding device is mounted, an actual side end position of the paper deviates by the irregularity of the mounting positions. When the actual side end position of the paper deviates from the design (theoretical) side end position of the paper, even if the recording starting position is calculated based on the standard position such as the design side end position, a mounting deviation amount is not considered in the calculation value. For this reason, a printing target such as a document or an image is printed in a recording range that deviates in the width direction of the paper against the print setting such as the margin amount. For this reason, in the case of printing the paper that is fed from the additional paper feeding device, there was a problem in that the margin amount of the print setting is not ensured, or a minute margin is generated at an edge during borderless printing.

SUMMARY

An advantage of some aspects of the invention is to provide a recording apparatus that is able to suppress the deviation of a recording range onto a recording medium due to a mounting deviation of a detachable feeding device, and a recording method in the recording apparatus.

According to the aspect of the invention, there is provided a recording apparatus on which a feeding device is detachably mounted for feeding a recording medium, the recording apparatus includes a transport unit that transports the recording medium; a recording unit that records the recording medium; an acquisition unit that acquires a theoretical side end position in a width direction intersecting with a transport direction of the recording medium; a detection unit that detects a side end position of the recording medium fed from the feeding device in a feeding course; a calculation unit that calculates a deviation amount between the side end position detected by the detection unit and the theoretical side end position as an adjustment amount; and an adjustment unit that adjusts a limit position of a recording range in the width direction in which the recording of the recording unit is permitted by the use of the adjustment amount.

According to the aspect of the invention, the detection unit detects the side end position of the recording medium fed from the feeding device in a feeding course. Moreover, the calculation unit calculates the deviation amount between the side end position detected by the detection unit and the theoretical side end position as the adjustment amount. The adjustment unit adjusts the limit position of the recording range in the width direction in which the recording of the recording unit is permitted by the use of the adjustment amount. Thus, it is possible to suppress the deviation of the recording range to the recording medium in the width direction due to the mounting deviation of the detachable feeding device.

In the recording apparatus according to the aspect of the invention, it is preferable that the detection unit detect the side end position of the recording medium which is fed from the feeding device in the first page of the initial recording after the feeding device is mounted after the power source is input.

According to the aspect of the invention, the detection unit detects the side end position of the recording medium which is fed from the feeding device in the first page of the initial recording after the feeding device is mounted after the power source is input. Thus, when the recording is performed by the feeding from the detachable feeding device, it is possible to suppress the deviation of the recording range in the width direction from the first page of the initial recording.

In the recording apparatus according to the aspect of the invention, it is preferable that the recording unit be a carriage which has a recording head and can be moved in the width direction, the detection unit include a medium width detection unit which is provided in the carriage and can detect both side end positions of the recording medium in the width direction by the movement of the carriage, the detection unit move the carriage before the recording starting in the feeding course from the feeding device to detect both side end positions including the side end position of the recording medium by the medium width detection unit, and the adjustment unit adjust the recording starting position of the recording head, which is moved together with the carriage by the use of the adjustment amount to perform the recording.

According to the aspect of the invention, both side end positions of the recording medium in the width direction are detected by the medium width detection unit provided in the carriage. The adjustment amount is calculated by the use of at least one side end position of the both side end positions detected at this time. Moreover, the recording starting position of the recording head is adjusted by the adjustment unit by the use of the adjustment amount. Thus, in the serial type recording apparatus, the recording starting position of the recording head is adjusted, whereby it is possible to suppress the deviation of the recording range of the recording medium in the width direction.

In the recording apparatus according to the aspect of the invention, it is preferable that an error detection unit be further included which detects the feeding error of the recording medium, when the feeding error of the recording medium is detected before the adjustment by the adjustment unit, the side end position is detected in the next feeding course from the feeding device after the feeding error is released, and the adjustment unit adjusts the limit position of the recording range by the use of the acquired adjustment amount.

According to the aspect of the invention, when the feeding error of the recording medium is detected before the adjustment by the adjustment unit, by the use of the adjustment amount based on the side end position detected in the next feeding course from the feeding device after the feeding error is released, the adjustment unit adjusts the limit position of the recording range. Thus, even when the feeding error is generated, and it is difficult to acquire one of the side end position, the adjustment amount, and the limit position of the recording range, and as a result, it is difficult to adjust the limit position of the recording range, the adjustment amount is acquired again in the next feeding course from the feeding device after the feeding error is released. For this reason, even when the feeding error is unintentionally generated when the adjustment amount is initially acquired, it is possible to suppress the deviation of the recording range in the width direction during next recording.

In the recording apparatus according to the aspect of the invention, it is preferable that a determination unit be further included which determines whether or not a deviation amount exceeds the limit value, and the adjustment unit limits the adjustment amount to the limit value when it is determined that the deviation amount exceeds the limit value.

According to the aspect of the invention, when it is determined that the deviation amount exceeds the limit value, the adjustment amount is limited to the limit value by the determination unit. The adjustment unit adjusts the limit position of the recording range by the use of the limited adjustment amount. For example, even when an excessive deviation amount is generated due to the fact that the recording medium set position in the feeding device deviates, the limit position of the recording range is adjusted by the use of the adjustment amount limited to the limit value. Thus, the limit position of the recording range is adjusted according to the deviation of the set positions, and then it is possible to avoid the disadvantage due to that fact that the excessive adjustment amount is continuously used.

In the recording apparatus according to the aspect of the invention, it is preferable that, after the limit position of the recording range is adjusted by the adjustment unit, until the power source is cut off, the recording by the recording unit is performed by the use of the limit position of the adjusted recording range.

According to the aspect of the invention, after the limit position of the recording range is adjusted by the adjustment unit, until the power source is cut off, the recording by the recording unit be performed by the use of the limit position of the adjusted recording range. Thus, whenever the recording medium fed from the feeding device is recorded, the processes including the detection of the side end position, the calculation of the adjustment amount, and the adjustment of the limit position of the recording range are not performed. As a consequence, it is possible to improve throughput of the recording to the recording medium that is fed from the feeding device.

In the recording apparatus according to the aspect of the invention, it is preferable that the feeding device be a center feeding type that guides the recording medium near the center.

According to the aspect of the invention, when the feeding device is a center feeding type, the side end position is changed depending on the size of the recording medium, but since the limit position of the recording range is adjusted for each size of the recording medium, it is possible to suppress the deviation of the recording range by the recording unit in any size of the recording medium.

According to another aspect of the invention, there is provided a recording method in the recording apparatus on which a feeding device detachably is mounted for feeding a recording medium, the method includes detecting a side end position in a width direction intersecting with a transport direction of the recording medium fed from the feeding device in a feeding course; calculating a deviation amount between the side end position detected during the detecting of the side end position and a theoretical side end position as an adjustment amount; and adjusting a limit position of a recording range in the width direction in which the recording of the recording unit is permitted by the use of the adjustment amount. According to another aspect of the invention, it is possible to obtain the same effect as the invention relating to the recording apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
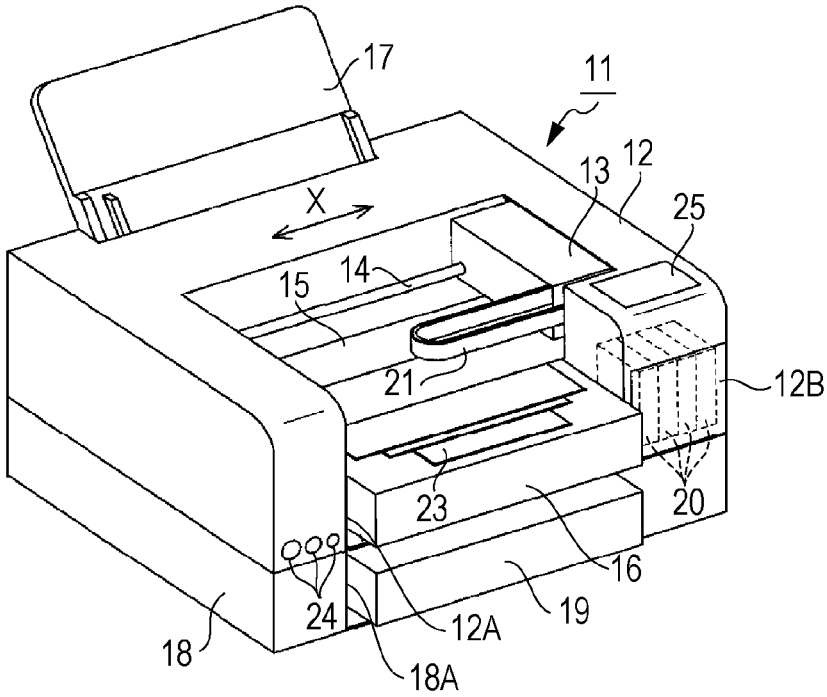
FIG. 1 is a perspective view of a printer in an embodiment in which the invention is embodied.

Hereinafter, an embodiment embodying the invention will be described according to FIGS. 1 to 9. As shown in FIG. 1, in a middle lateral length concave region of a rectangular box-shaped main body 12 in a printer 11 as an example of the printing apparatus, a carriage 13 is guided in a guide shaft 14 and is provided in a main scanning direction (left and right direction in FIG. 1) in a freely reciprocating manner.

As shown in FIG. 1, in the main body 12, in a lower position facing the carriage 13, an elongated plate-shaped support table 15 is disposed. In a front (a front side surface in FIG. 1) lower portion if the printer 11, a paper feeding cassette 16 is mounted on a concave target mounting portion 12A in an insertable and extractable manner. Furthermore, on the back side upper portion of the main body 12, a paper feeding tray 17 is provided. In the present embodiment, it is possible to perform the switching and the selection between the paper feeding from the paper feeding cassette 16 of the device front portion and the paper feeding from the paper feeding tray 17 of the device back portion.

Furthermore, the printer 11 of the present embodiment has a configuration in which an additional feeding device 18 can be mounted at the lower side of the main body 12 in an attachable and detachable state. FIG. 1 shows the state in which the additional feeding device 18 is mounted at the lower side of the main body 12 of the printer 11. The additional feeding device 18 is configured so that, in a target mounting portion 18A recessed in the middle of the width direction, an additional paper feeding cassette 19 (hereinafter, also referred to as an "additional cassette 19") is mounted in an insertable and extractable manner. As shown in FIG. 1, in the state in which the additional feeding device 18 is mounted, it is possible to perform the switching and the selection of the paper feeding from the paper feeding cassette 16 of the device front portion, the paper feeding from the additional cassette 19, and the paper feeding from the paper feeding tray 17 of the device back portion.

Furthermore, in a cover 12B that covers a right end portion front surface of the main body 12, a plurality of ink cartridges 20 is loaded. Ink of each ink cartridge 20 is supplied into the carriage 13 through ink supply tubes of a plurality of lines (not shown) that are attached to a flexible wiring plate 21, respectively. Moreover, ink droplets are ejected (discharged) from a recording head 22 (shown in FIG. 2) provided in the lower portion of the carriage 13. In addition, in the recording head 22, pressing elements (a piezoelectric element, an electrostatic element, a heating element or the like) applying the ejection pressure to the ink are provided for each nozzle, and a predetermined voltage is applied to the pressing element, whereby ink droplets are ejected (discharged) from the corresponding nozzles, respectively. In addition, the loading method of the ink cartridge is not limited to a so-called on-carriage type in which the ink cartridge is loaded on the carriage 13, but may be a so-called off-carriage type in which the ink cartridge is loaded on a cartridge holder (not shown) provided at the printer main body side.

At the time of the printing, for example, the ink droplets are ejected from the recording head 22 to a paper which is fed from the paper feeding cassette 16 or the additional cassette 19 and is situated on the support table 15 in the course in which the carriage 13 is moved in the main scanning direction, whereby the printing of one line (one row) is performed. After the printing of one line is finished, the paper is transported to the printing position of the next row. In this manner, the printing operation by one scanning of the carriage 13 and the transport operation (the paper feeding operation) of transporting the paper up to the printing position of the next row are alternately repeated, whereby the printing on the paper proceeds. Moreover, the printed paper is discharged onto a three-stage slide type paper discharging tray 23 provided at the upper side of the paper feeding cassette 16. Herein, the printing operation and the transport operation may be temporally and exclusively performed, but may be performed at the timing at which the other operation is started before one operation is finished, and the mutual operations partially overlap with each other at the same time.

Furthermore, as shown in FIG. 1, in a place close to the front surface left side of the main body 12, an operation portion 24 constituted by various operation switches including a power source switch is provided. Furthermore, at an upper surface right side of the main body 12, a display portion 25 is provided.

Figure 2:
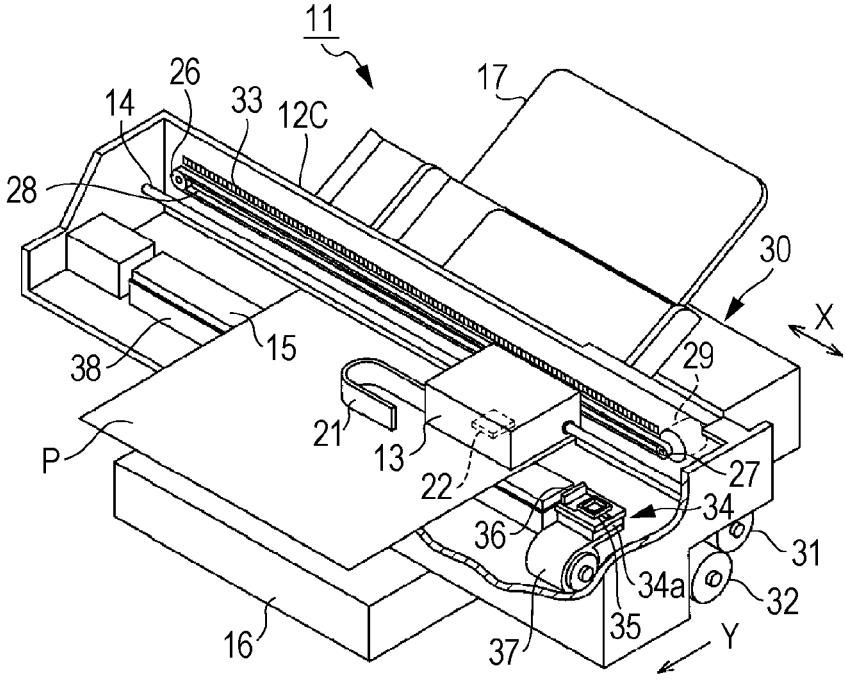
FIG. 2 is a perspective view of the printer of the state in which an exterior case is removed.

Next, a configuration of the printer will specifically be described using FIG. 2. As shown in FIG. 2, the printer 11 includes an approximately rectangular box-shaped main body frame 12C with an opened upper side. The carriage 13, which is guided to the guide shaft 14 attached to the inner portion of the main body frame 12C in a main scanning direction (an X direction in FIG. 2) and can reciprocate, is fixed to an endless timing belt 28 that is wound around a pair of pulleys 26 and 27 disposed on a back plate surface of the main body frame 12C. A carriage motor (hereinafter, referred to as a "CR motor 29") connected to one pulley 27 at a driving shaft thereof is driven in a forward and backward rotation direction, whereby the carriage 13 reciprocates in the main scanning direction X.

In the lower portion of the back side of the printer 11, a rear feeding device 30 is provided which separates only an uppermost sheet of a plurality of papers P stacked on the paper feeding tray 17 and supplies the same to the downstream side in a sub scanning direction Y. In the lower portion of the right side of the main body frame 12C shown in FIG. 2, a feeding motor (hereinafter, also referred to as an "ASF motor 31") and a paper feeding motor (hereinafter, also referred to as a "PF motor 32") are dispose, respectively.

The ASF motor 31 is driven, whereby among the papers P set in the paper feeding cassette 16 or in the additional cassette 19, or the papers P stacked on the paper feeding tray 17 on the rear feeding device 30, an uppermost sheet is fed. Moreover, the PF motor 32 is driven together with the driving of the ASF motor 31, whereby the paper P is transported (loaded) up to the printing starting position. After the paper P is loaded, by approximately alternately performing the ink ejection operation (the printing operation) of the recording head 22 performed in the course of the reciprocation of the carriage 13 by the driving of the CR motor 29 in the main scanning direction X, and the paper feeding operation which transports the paper P up to the print position of the next row in the sub scanning direction Y the driving of the PF motor 32, the printing of the image or the like based on the printing data is performed on the paper P.

Furthermore, as shown in FIG. 2, in the printer 11, a linear encoder 33, which outputs a pulse of the number proportional to the movement distance of the carriage 13, is installed so as to be extended along the guide shaft 14. The speed control and the position control of the carriage 13 are performed based on the movement position, the movement direction, and the movement speed of the carriage 13 that are obtained by the use of the output pulse of the linear encoder 33. In addition, immediately below the carriage 13 upon being situated in a home position (a right end position on a carriage movement path in FIG. 2) in the printer 11, a maintenance device 34 is provided which performs the cleaning or the like for preventing and solving the nozzle jam or the like of the recording head 22.

The maintenance device 34 shown in FIG. 2 includes a cap 35 functioning as a cover that prevents the thickening or the drying of ink in the nozzles by coming into contact with a nozzle forming surface 22*a* (see FIGS. 3 and 4) of the recording head 22, a wiper 36 for wiping the nozzle forming surface 22*a*, and a suction pump 37. The cap 35 ascends and descends between a capping position coming into contact with the recording head 22 and a retracted position separated from the recording head 22 by a lifting mechanism 34*a*.

Furthermore, in addition to the cover function (the capping function), the cap 35 also includes the function as a part of a liquid suction unit that caps the nozzle forming surface 22*a* of the recording head 22, gives an internal space thereof the negative pressure from the suction pump 37, and forcibly sucks and discharges ink from the nozzles. The waste ink sucked and discharged from the nozzles into the cap 35 is discharged to a waste liquid tank 38 disposed below the support table 15 by the driving of the suction pump 37.

Next, a mechanism, which performs the paper feeding and the transportation from two paper feeding cassettes 16 and 19, will be described by the use of FIG. 3. In the printer 11 of the present embodiment, the control of doing the feeding operation of the subsequent paper P2 in parallel during the recording operation onto the preceding paper P1. In addition, in FIG. 3, a feeding device of a rear side is omitted.

Figure 3:
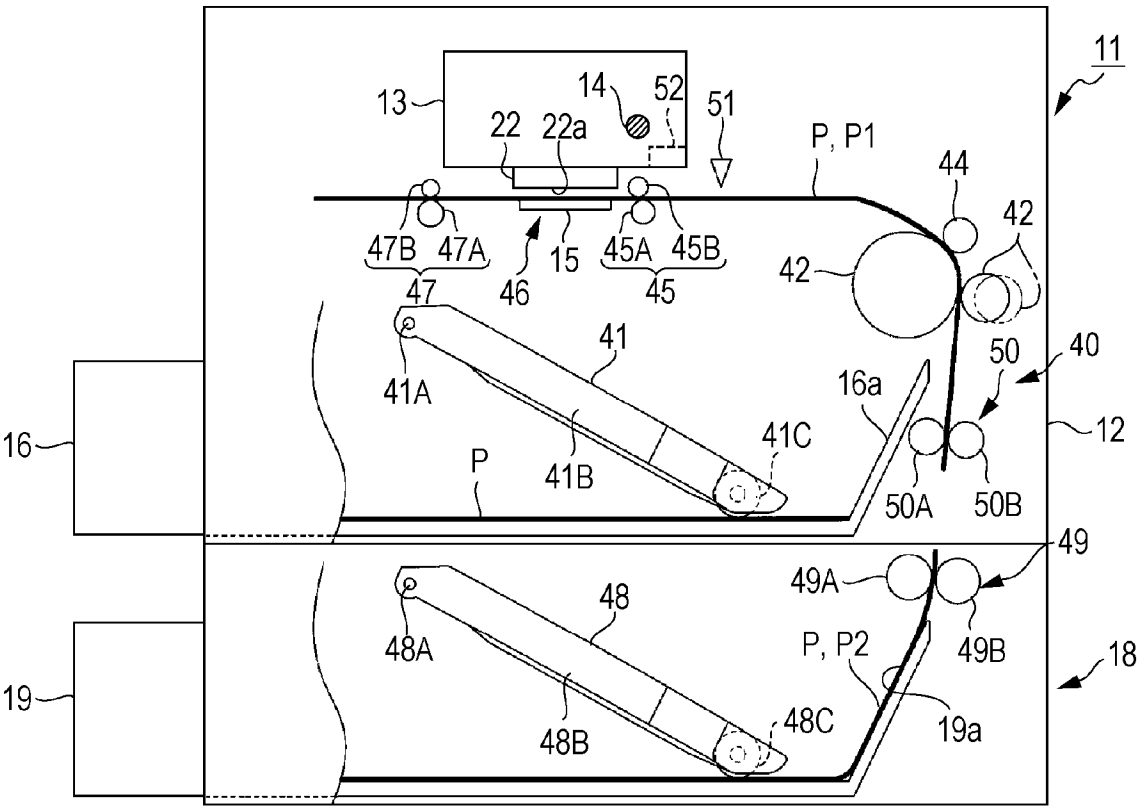
FIG. 3 is a schematic side view that describes a feeding and transport system of the printer.

As shown in FIG. 3, a front feeding device 40 provided near the bottom portion of the main body 12 of the printer 11 includes a paper feeding cassette 16, a pickup roller 41, a middle roller 42, a retard roller 43, and an assist roller 44.

In the paper feeding cassette 16 which can be mounted and removed from the device front side, a plurality of sheets of paper P can be set, and the uppermost one of the set papers P is sent from the paper feeding cassette 16 by a pickup roller 41 driven by an ASF motor 31 (shown in FIG. 2) one by one. The pickup roller 41 is in the state in which a roller 41C provided in the tip of a swing member 4B capable of swinging in the state of being biased to the paper side by a biasing unit (not shown) around a swing shaft 41A always comes into contact with the uppermost paper.

The paper P to be sent by the pickup roller 41 is preliminarily separated by a separation slope surface 16*a*, and then proceeds to the retard roller 43. The retard roller 43 is provided in a position facing an outer peripheral surface of the middle roller 42, and is provided so that it can advance or retreat with respect to the middle roller 42. The retard roller 43 is brought into pressure-contact with the middle roller 42 to form a nip point, thereby separating the uppermost paper P (the preceding page) to be fed and the paper P after the next page.

The middle roller 42 constituting a transport unit, which sends the paper P fed by the pickup roller 41 to the further downstream side, is driven by the PF motor 32 (shown in FIG. 2), bends and reverses the paper to be fed, and sends the paper P to the transport roller pair 45 of the downstream side. An assist roller 44 comes into contact with the middle roller 42 to assist the transportation to the paper P by the middle roller 42 to the downstream side.

The transport roller pair 45 includes a transport driving roller 45A which is rotated and driven by the PF motor 32 (FIG. 2), and a transport driven roller 45B which comes into pressure-contact with the transport driving roller 45A and is subjected to the driven rotation. The transport driving roller 45A is rotated in the state of being nipped by the transport driving roller 45A and the transport driven roller 45B, whereby the paper P, the tip of which reaches the transport roller pair 45, is transported to the recording portion 46 of the downstream side.

The recording portion 46 shown in FIG. 3 includes the recording head 22 that discharges ink toward the paper P, and the support table 15 that restricts a distance between the paper P and the recording head 22 by supporting the paper P. The recording head 22 is provided in the bottom portion of the carriage 13, and the carriage 13 is driven so as to reciprocate in the main scanning direction X by the CR motor 29 (shown in FIG. 2) while being guided in the guide shaft 14 extending in the main scanning direction (a direction perpendicular to the paper surface of FIG. 3).

A paper discharging roller pair 47 provided at the downstream side (a left side in FIG. 3) in the transport direction of the recording portion 46 includes a discharge driving roller 47A that is rotated and driven by the PF motor 32 (FIG. 2), and a discharge driven roller 47B that is subjected to the driven rotation while coming into contact with the discharge driving roller 47A. The discharge driving roller 47A is rotated and driven in the state of being nipped by the discharge driving roller 47A and the discharge driven roller 47B, whereby the paper P recorded by the recording portion 46 is discharged to the paper discharging tray 23 provided at the device front side. In addition, in the present embodiment, the transport unit is constituted by the PF motor 32, the transport roller pair 45, the paper discharge roller pair 47 or the like.

Meanwhile, the additional front feeding device 18 includes the additional cassette 19, the pickup roller 48, and the feeding roller pair 49. Furthermore, a feeding roller pair 50 is also provided at the main body 12 side. The additional feeding device 18 is electrically connected to a terminal of the main body 12 side by being mounted on the bottom surface of the main body 12, and is connected so that it can transmit the power of the ASF motor 31 and the PF motor 32 to the pickup roller 48 and the feeding roller pair 49.

The pickup roller 48 is configured so that a roller 48C provided in the tip of the swing member 48B capable of swinging in the state of being biased to the paper side by a biasing unit (not shown) around the swing shaft 48A always comes into contact with the uppermost paper. The power of the ASF motor 31 is transmitted via a power transmitting mechanism (not shown), whereby the roller 48C of the pickup roller 48 is rotated.

The feeding roller pair 49 in FIG. 3 includes a feeding driving roller 49A that is rotated and driven by the ASF motor 31 (FIG. 2), and a feeding driven roller 49B that is subjected to the driven rotation while coming into contact with the feeding driving roller 49A. The feeding driving roller 49A is rotated in the state of being nipped by the feeding driving roller 49A and the feeding driven roller 49B, whereby the paper P, the tip of which reaches the feeding roller pair 49, is transported to the main body 12 side.

Furthermore, the feeding roller pair 50 of the main body 12 side shown in FIG. 3 includes a feeding driving roller 50A that is rotated and driven by the PF motor 32 (FIG. 2), and a feeding driven roller 50B that is subjected to the driven rotation while coming into contact with the feeding driving roller 50A. The feeding driving roller 50A is rotated in the state of being nipped by the feeding driving roller 50A and the feeding driven roller 50B, whereby the paper P, the tip of which reaches the feeding roller pair 50, is transported to the retard roller 43 side.

The paper P fed by the pickup roller 48 in the additional cassette 19 is preliminarily separated by a separation slope surface 19*a*, and proceeds between the middle roller 42 and the retard roller 43 while being nipped by the feeding roller pair 49 and 50. If the paper is fed in an overlapped manner, in the nip point between the retard roller 43 and the middle roller 42, the uppermost paper P (the preceding page) to be fed and the paper P after the next page are separated from each other. The paper transported from the additional cassette 19 to the retard roller 43 is then transported to the transport roller pair 45 by the use of a part of the feeding device 40.

In a predetermined position between the assist roller 44 and the transport roller pair 45 on the paper transport path, a paper detection sensor 51 is disposed. The paper detection sensor 51 is situated so as to face the transport path of the paper P fed and transported from the paper feeding cassettes 16 and 19 side, and is configured so that it can detect the tip and the rear end of the paper P. The paper detection sensor 51 detects the tip of the paper P so that the detection state thereof is switched from "paper absence" to "paper presence", and detects the rear end of the paper P so that the detection state thereof switched from "paper presence" to "paper absence".

In the printer 11 of the present embodiment, in a high speed printing mode (a draft printing mode) of a plurality of printing modes, when the preceding paper P1 is transported to a prescribed position, even in the process of printing, the paper feeding control of starting the feeding of the subsequent paper P2 is performed. For this reason, as shown in FIG. 3, when a sensor (not shown) detects that the rear end of the preceding paper P1 reaches the prescribed position, the pickup rollers 41 or 48 are driven to start the feeding of the subsequent paper P2. Moreover, when a sensor (not shown) detects that the tip of the subsequent paper P2 reaches a standby position which can ensure a predetermined gap between the tip and the rear end of the preceding paper P1, the driving of the pickup roller 41 or 48 is stopped. Moreover, after that, when the preceding paper is transported, the preceding paper and the subsequent paper are simultaneously transported in parallel while holding a predetermined gap.

The carriage 13 is provided with a paper width detector 52 in the position of the upstream side in the transport direction from the recording head 22. The paper width detector 52 includes a transmission type optical sensor that performs the detection, for example, when light is blocked by the paper, or a reflection type optical sensor that detects light reflected by the surface of the paper. The paper width detector 52 detects both side end positions (both side end positions) of the paper P in the width direction (the main scanning direction X). Moreover, the paper width is obtained based on the respective detection results of the paper width detector 52.

Figure 4:
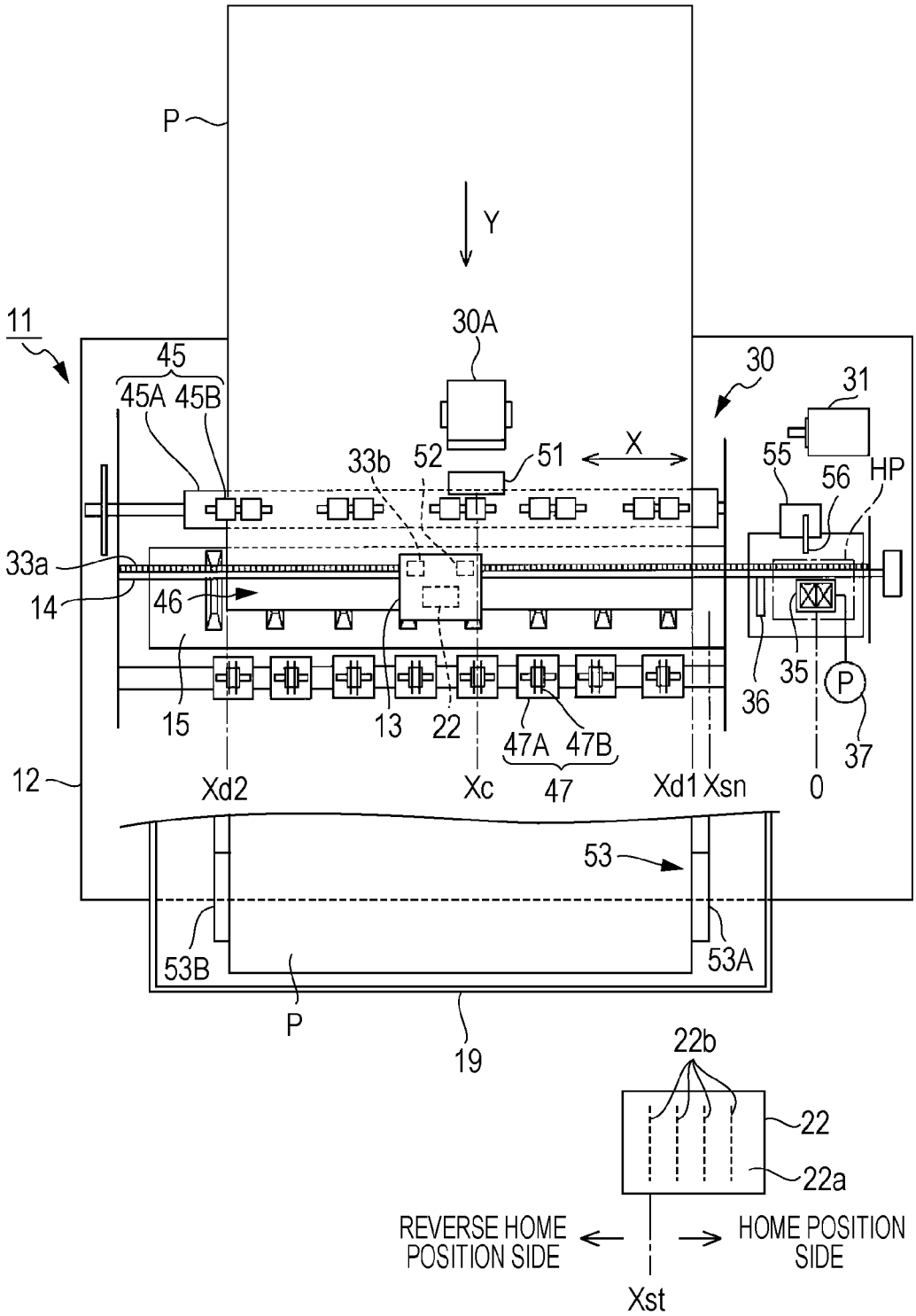
FIG. 4 is a schematic plan view that shows an inner portion of the printer.

Next, a configuration will be described which obtains the ejection starting position of the recording head 22, by the use of FIG. 4. In addition, in FIG. 4, a part is shown in a cross section so that the additional cassette 19 is viewed. In FIG. 4, a position (an alternate long and short dash line in FIG. 4) of the carriage 13 when the recording head 22 and the cap 35 coincide to each other in the main scanning direction X is a home position HP. The position (that is, the carriage position) of the carriage 13 in the main scanning direction X setting the home position Hp as an original point is acquired by counting the detection pulse of the linear encoder 33.

The linear encoder 33 includes a tape-shaped code disc 33*a* (a linear scale) formed with a plurality of slits for each certain pitch (for example, 1/180 inches (=1/(180×2.54) cm)), and a sensor 33*b* having a light emitting element and a light reception element provided in the carriage 13, and has a configuration in which the light reception element receives light emitted from the light emitting element and passed through the slit when the carriage 13 is moved, whereby the sensor 33*b* outputs the detection pulse. For example, the pulse edge of the detection pulse (two pulses of an A phase and a B phase having a phase deviation of 90°), which is input from the linear encoder 33, is counted, and the carriage position is obtained from the counted value.

As shown in FIG. 3, the carriage position is defined so that, as the carriage 13 is situated at a counter-position side (a left side in FIG. 3) setting the original point in the home position HP as "0", the numerical value is increased. In addition, in the present embodiment, in the movement path of the carriage 13, the home position HP side is also called a "1 digit side", and the counter-home position side is also called "80 digit sides".

As shown in FIG. 4, in the bottom portion of the additional cassette 19, a paper guide 53 capable of realizing the center paper feeding is provided. Herein, the center paper feeding refers to a mode in which the paper feeding is performed while guiding the paper in the width direction (the main scanning direction X) so that the width center of the paper is always in the same position (a center position Xc) even in the different paper sizes. The paper guide 53 includes a pair of movable guide portions 53A and 53B that are able to guide both ends (both side ends) of the paper P in the width direction accommodated in the additional cassette 19. The pair of movable guide portions 53A and 53B is configured so as to be slidable while taking the bilateral symmetrical position in the main scanning direction X with respect to the center position Xc.

As shown in FIG. 4, in the paper P (the paper during transportation in FIG. 4) fed from the additional cassette 19 while being guided to the pair of movable guide portions 53A and 53B, the width center thereof coincides with the center position Xc regardless of the paper sizes. Since the other paper feeding cassette 16 also includes the same paper guide 53 and the paper is guided to the pair of movable guide portions 53A and 53B in the width direction, the center paper feeding is similarly performed in the other paper feeding cassette 16. Furthermore, in the paper feeding tray 17 of the rear side, since the paper is similarly guided to the pair of movable guide portions, the center paper feeding is possible.

In the center paper feeding method, the design (theoretical) side end position of the paper is set for each paper size. Herein, based on the design side end position of the paper, the ejection starting position allowing the starting of the ink ejection from the recording head 22 may be determined. However, the ejection starting position is determined depending on an actual side end position of the paper in consideration of the mounting position in the main scanning direction X when the detachable additional cassette 19 is mounted on the main body 12. In the present embodiment, upon obtaining the ejection starting position, a design (theoretical) first side end position Xsn in the main scanning direction X is defined for each paper size.

In the example shown in FIG. 3, the first design side end position Xsn is defined by formula Xsn=Xc−PW/2 by the use of the center position Xc and a paper width PW determined from information of the paper size at that time. If the paper size is defined in this manner, it is possible to obtain the first design side end position Xsn by the calculation for each paper size. Moreover, the ejection starting position can be obtained from the printing set information and the side end position concerning the layout such as a margin amount or presence or absence of the borderless printing.

In the paper feeding cassette 16, the position deviation of the mounting position is hardly generated with respect to the main body 12 in the main scanning direction X (the paper width direction). Moreover, since the setting amount ΔB relative to the first side end position is defined by the use of the layout information such as the margin amount or presence or absence of the borderless printing that is set as the printing set information, the ejection starting position is obtained by adding the setting amount ΔB to the first side end position.

As shown in a right bottom in FIG. 3, on the nozzle forming surface 22*a* of the recording head 22, a plurality (for example, four) of nozzle rows 22*b* is arranged along the paper transport direction Y. The respective nozzle rows 22*b* are constituted by, for example, 180 nozzle groups that are disposed along the Y direction in a zigzag manner. The plurality of nozzle rows 22*b* of the recording head 22 is permitted to start to eject the ink droplets upon coinciding with the ejection starting position Xst (for example, Xst=Xd1), respectively.

A switching holding device 55 includes a lever type power switching member 56 which is engaged in the movement course, before the carriage 13 reaches the home position HP, is able to perform the pushing operation, and is switched by operating the power switching member 56 by the carriage 13. The switching holding device 55 selects one of the rear feeding device 30, the front feeding device 40, and the additional feeding device 18 as the power transmission place of the ASF motor 31, depending on the disposition position of the carriage 13.

The first side end position of the home position HP side (one digit side) of the paper P during printing in the width direction (the X direction) is changed depending on the paper sizes of the paper P to be guided to the pair of guides 53A and 53B. A value Xd1 of a first paper end position is indicated as a value (a distance) from the home position HP (the original point O). Furthermore, when setting a value expressing the width (the width of the X direction) of the paper P to PW, a second side end position Xd2 of the counter-home position side (80 digit side) of the paper P is indicated by Xd2=Xd1+PW.

Furthermore, the rear feeding device 30 includes a paper feeding roller 30A, and the paper feeding roller 30A is rotated and driven based on the driving force of the ASF motor 31 transmitted via the switching holding device 55 and feeds only an uppermost sheet of the papers P set on the paper feeding tray 17 during paper feeding. Moreover, it is configured so that the tip of the fed paper P is detected by the paper detection sensor 51 situated at the upstream side of the transport direction further than the recording head 22.

Furthermore, the paper width detector 52 moving with the carriage 13 detects the "paper presence" when the light receptor receives the reflected light generated by the reflection of light emitted from a projector by the paper P, and detects the "paper absence" when the paper P is absent and the reflected light cannot be received by the light receptor. Moreover, the side end position of the paper P is detected from the position of the carriage 13 when being switched from the "paper presence" to the "paper absence". Of course, the paper width detector 52 may be a transmission type. Furthermore, the paper width detector 52 may have a configuration that detects the paper, when a reflection mirror is installed at an opposite side with the paper transport path interposed therebetween, the reflected light reflected by the reflection mirror is blocked by the paper and light cannot be received.

Figure 5:
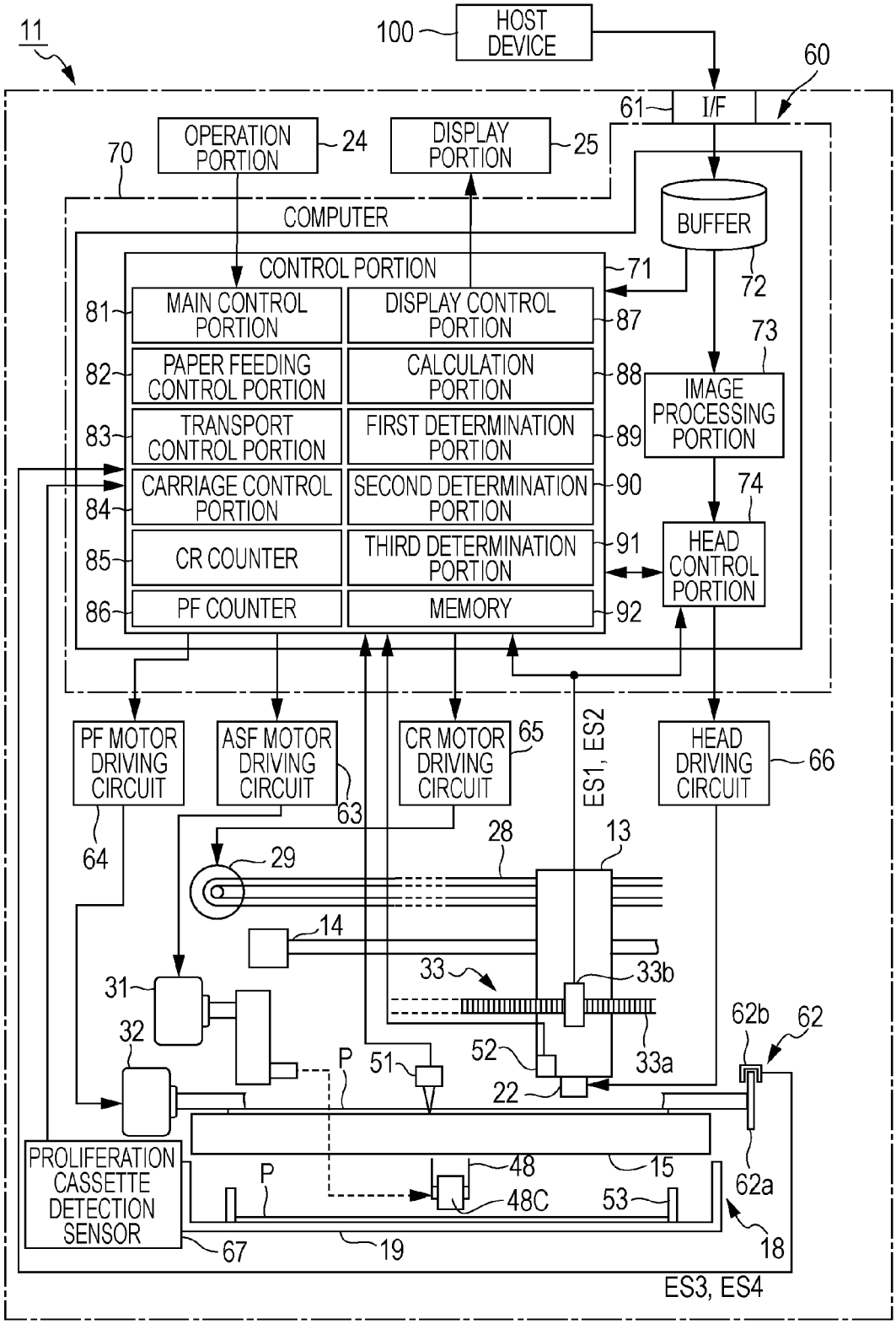
FIG. 5 is a block diagram that shows an electrical configuration and a partial functional configuration of the printer.

Next, an electrical configuration of the printer 11 will be described based on FIG. 5. As shown in FIG. 5, a host device 100 is connected to the printer 11 in a communicatable manner. The host device 100 is constituted by, for example, a personal computer, a portable terminal or the like, and is equipped with a printer driver (not shown). The printer driver creates the printing data from the image data of the printing target, and sends (transmits) the printing data to the printer 11. At this time, the printer driver performs a predetermined image process such as a resolution conversion process, a color conversion process, a halftone process, a rasterize process on the image data, and creates the printing image data of CMYK color base.

Furthermore, when performing the printing, a user inputs the printing set information (the printing condition information) to the host device 100. The printing set information includes paper type, paper size, printing quality (high quality (photography printing)/standard/low quality (draft mode printing or the like)), printing color (color/gray scale) or the like. The printer driver adds a command described as a printing language and partial printing set information including at least the printing size to the printing image data, and creates the printing data. Moreover, the printer driver transmits the created printing data to the printer 11.

As shown in FIG. 5, the printer 11 includes a controller 60, and an interface (hereinafter, referred to as am "I/P 61"), includes the CR motor 29, the ASF motor 31, the PF motor 32 as a driving system, and includes the linear encoder 33, the paper detection sensor 51, and the rotary encoder 62 as a detection system. Furthermore, the printer 11 includes an ASF motor driving circuit 63 for driving and controlling the respective motors 29, 31, and 32 of the driving system, a PF motor driving circuit 64, a CR motor driving circuit 65, and a head driving circuit 66 for driving and controlling the recording head 22. Furthermore, the printer 11 includes an operation portion 24 and a display portion 25. In addition, the printer 11 is provided with an additional cassette detection sensor (hereinafter, simply referred to as an "additional detection sensor 67") which detects that the additional feeding device 18 (in other words, an additional cassette 19) is mounted on the main body 12.

The printer 11 receives the printing data from the host device 100, for example, a personal computer or the like) via the I/F 61. The received printing data is acquired to the controller 60.

The controller 60 is equipped with a computer 70. The computer 70 includes a CPU, a ROM, a RAM, a nonvolatile memory or the like, and further includes an ASIC (Application Specific IC) as necessary. Moreover, the computer 70 has various functional portions that are realized by software realized by the execution of the program memorized in the ROM or the nonvolatile memory by the CPU, and hardware realized by various electronic circuits of the ASIC as necessary. In FIG. 5, in the computer 70, various functional portions are shown. That is, the computer 70 includes a control portion 71, a buffer 72, an image process portion 73, and a head control portion 74. The buffer 72 is constituted, for example, by the use of a partial memory region of the RAM.

Next, the respective portions 71 to 74 constituting the computer 70 will be described.

The printing data acquired from the host device 100 via the I/F 61 is temporarily stored in the buffer 72. The control portion 71 reads the command of the printing data stored in the buffer 72, interprets the command, and drives and controls of various motors 29, 31, and 32 according to the instruction of the interpreted command.

The image process portion 73 reads the printing image data (a raster data) of the printing data from the buffer 72 and performs the required image process. As a result, the head control data of the data form is created, which can be used in the control of the recording head 22 by the head driving circuit 66. The image process portion 73 sends the created head control data to the head control portion 74. The head control portion 74 transmits the head control data to the head driving circuit 66 while adjusting the timing together with the control portion 71. The head driving circuit 66 performs the ink ejection control of the recording head 22 by driving the ejection driving element provided for each nozzle in the recording head 22 based on the control data.

Furthermore, the control portion 71 also performs the display control of the display portion 25 in addition to governing various controls of the feeding system, the transport system, and the carriage driving system. In order to perform such a control, as shown in FIG. 5, the control portion 71 includes a main control portion 81, a feeding control portion 82, a transport control portion 83, a carriage control portion 84, a CR counter 85, and a PF counter 86. The main control portion 81 issues various instructions required for the printing control to the feeding control portion 82, the transport control portion 83, and the carriage control portion 84.

The feeding control portion 82 drives and controls the ASF motor 31 via the ASF motor driving circuit 63, and performs the feeding control of the paper. At this time, depending on the disposition position of the carriage 13 as the power transmission place of the ASF motor 31, the switching holding device 55 selects one of the rear feeding device 30, the front feeding device 40, and the additional feeding device 18. Furthermore, the transport control portion 83 drives and controls the PF motor 32 via the PF motor driving circuit 64, and performs the transport control (the paper feeding control) of the paper. Furthermore, the carriage control portion 84 drives and controls the CR motor 29 via the CR motor driving circuit 65, and controls the movement of the carriage 13 in the main scanning direction X.

The CR counter 85 counts the edges of two pulse signals ES1 and ES2 having the phase deviation of 90° that are input from the linear encoder 33 when the carriage is driven. The CR counter 85 increments the counted value when the carriage 13 is moved forward from the home position toward 80 digit side, and decrements the counted value when the carriage 13 is moved backward toward the home position (one digit side), thereby managing the movement position of the carriage 13.

The PF counter 86 manages the counted value depending on the transport position of the paper P by counting the edges of the pulse signals ES3 and ES4 that are input from the rotary encoder 62. Specifically, when the paper detection sensor 51 detects the tip of the paper P, the PF counter 86 is rest, and then, when the tip of the paper P reaches the head standard position, the paper detection sensor 51 is rest again. The counted value after the further rest indicates the transport position of the paper which sets the time when the tip of the paper reaches the head standard position as an original point. In addition, as shown in FIG. 5, the rotary encoder 62 has a code disc 62*a* that is fixed to an end portion of a shaft portion (for example, a shaft portion of the transport driving roller 45A) connected to the PF motor 32 in a power transmissible manner, and a sensor 62*b* that receives light transmitted through the slit of the code disc 62*a* and outputs two pulse signals ES3 and ES4 having the phase deviation of 90°.

Furthermore, the control portion 71 includes a display control portion 87, a calculation portion 88, a first determination portion 89, a second determination portion 90, a third determination portion 91, and a memory 92. The display control portion 87 performs the display control of displaying various menus or the content of an error when the error is generated on the display portion 25.

In the memory 92 (for example, a nonvolatile memory), information of the center position Xc is memorized. Furthermore, various flags are memorized in the memory 92. In the present embodiment, a paper end detection flag F1 and a limit determination flag F2 for the additional cassette are set. The paper end detection flag F1 is a flag for determining whether or not the paper end detection is performed in the first page of the initial printing by the paper feeding from the additional cassette 19 after the power source is turned on. The paper end detection flag F1 is set to "1" when the power source is turned on, and when the ejection starting position adjustment amount ΔX is set in the first page of the initial printing by the paper feeding from the additional cassette 19 after the power source is turned on, the paper end detection flag F1 is considered as "0". The paper end detection flag F1 is used in the determination by the first determination portion 89. Furthermore, the memory 92 is also used as a memory region that preserves the calculation result of the calculation portion 88.

The calculation portion 88 performs various calculations that include the calculation of the first design side end position Xsn or the ejection starting position. Furthermore, the calculation portion 88 calculates a deviation amount ΔX (=|Xd1−Xsn|) between the first side end position Xd1 that is actually detected by the paper width detector 52 and the first design side end position Xsn depending on the paper size of that time. At this time, as the paper size, one of the printing set information contained in the printing data is used, and the first design side end position Xsn (=Xc−PW/2) is acquired by the use of the paper width PW defined by the paper size and information of the center position Xc read from the memory 92. In the present embodiment, an example of the acquisition unit is constituted by the calculation portion 88 that calculates the first design side end position Xsn. Furthermore, the calculation unit is constituted by the calculation portion 88 that calculates the deviation amount ΔX (that is, the ejection starting position adjustment amount).

The first determination portion 89 determines whether or not the paper is fed from the additional cassette 19 and "1" is set in the paper end detection flag F1 for the additional cassette. That is, the first determination portion 89 determines whether or not the paper end detection of the first page of the initial printing by the paper feeding from the additional cassette 19 is performed after the power source is turned on. If the flag F1 is "1", It is determined that the paper end detection of the first page of the initial printing after the power source-on by the paper feeding from the additional cassette 19 is not performed, and meanwhile, if the flag F1 is "0", it is determined that the paper end detection of the first page of the initial printing after the power source-on by the paper feeding from the additional cassette 19 is performed in advance.

However, even when the additional feeding device 18 is mounted after the power source is turned on, the initial printing by the printing from the additional cassette 19 after the detection of the feeding device 18 is treated as the initial printing by the paper feeding from the additional cassette 19 after the power source is turned on. This is because, when the additional feeding device 18 is mounted, since the on signal is input from the additional cassette detection sensor 67, the paper end detection flag F1 is set to "1". In this manner, when the feeding device 18 is mounted after the power source is turned on, it is determined whether or not the paper end detection of the first page of the case of performing the initial printing after the mounting is performed.

The second determination portion 90 performs the error determination. The content of the determined error is a paper jam error, a document loading error or the like. When the second determination portion 90 determines the error, the indication is notified to the display control portion 87. The display control portion 87 displays the error content on the display portion 25 and notifies a user of the indication of the error occurrence.

The third determination portion 91 determines whether or not the deviation amount $|\Delta X|$ ($=|Xd1-Xsn|$) between the first side end position Xd1 detected by the paper width detector 52 and the first design side end position Xsn is equal to or less than a predetermined limit value L ($|\Delta X| \leq L$). Herein, when the limit value L is the deviation amount $|\Delta X|$ exceeding this value, the limit value L is set to a value to be determined that there is a high possibility that the paper set positions in the additional cassette 19 deviate in the width direction by a prescribed amount or more. The deviation amount $\Delta X$ exceeding the limit value L is not adopted as the ejection starting position adjustment amount. An upper limit or a lower limit of the ejection starting position adjustment $\Delta X$ is up to the limit value (L or −L).

Next, an action of the printer 11 will be described based on the flow chart shown in FIGS. 6 to 9.

Figure 6:
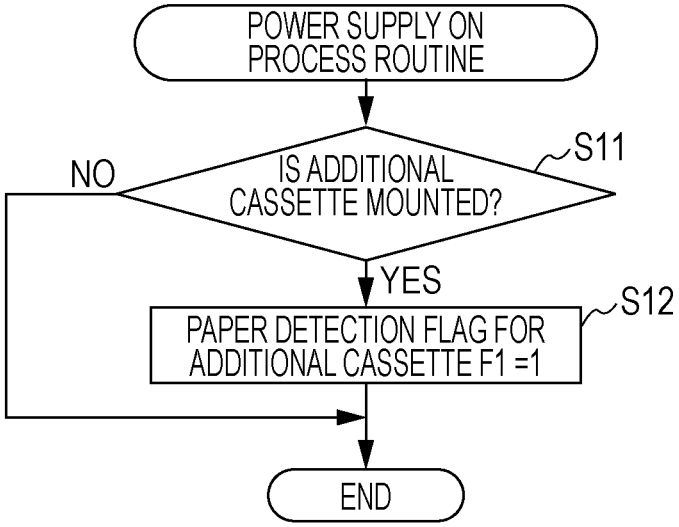
FIG. 6 is a flow chart that shows a power source-on process routine.

Firstly, when the power source is input by operating the operation portion 24 of the printer 11, the CPU in the computer 70 executes the power source-on routine process shown in FIG. 6. Firstly, in step S11, it is determined whether or not the additional cassette 19 is mounted. That is, from the additional detection sensor 67, it is determined whether or not the on-signal, which indicates that the additional feeding device 18 is mounted, is input. If the additional cassette 19 is mounted, "1" is set to the paper end detection flag F1 for the additional cassette. Meanwhile, if the additional cassette 19 is not mounted, the paper end detection flag F1 for the additional cassette is set to "0".

Next, when a user performs the operation for printing the printing target such as a document or an image by an input device, the printer driver is started, and the set screen is displayed on a monitor of the host device 100. A user inputs the printing set information including the paper size in the set screen. After that, when a user performs the operation of instructing the execution of the printing, the printer driver creates the printing data from the image data of the printing target, and transmits the same to the printer 11. At this time, the printing data transmitted to the printer 11 includes information of the paper size.

In the printer 11 receiving the printing data, the computer 70 performs the printing process based on the printing data. The computer 70 selects the used paper feeding cassette based on information of the specified paper size. For example, when the specified paper size is the same as the paper size of the paper P accommodated in the additional cassette 19, the additional cassette 19 is selected. When the additional cassette 19 is selected, the computer 70 performs the feeding process according to the additional cassette paper feeding process routine shown in FIGS. 8 and 9. Hereinafter, the additional cassette paper feeding process will be described based on FIGS. 8 and 9.

Figure 8:
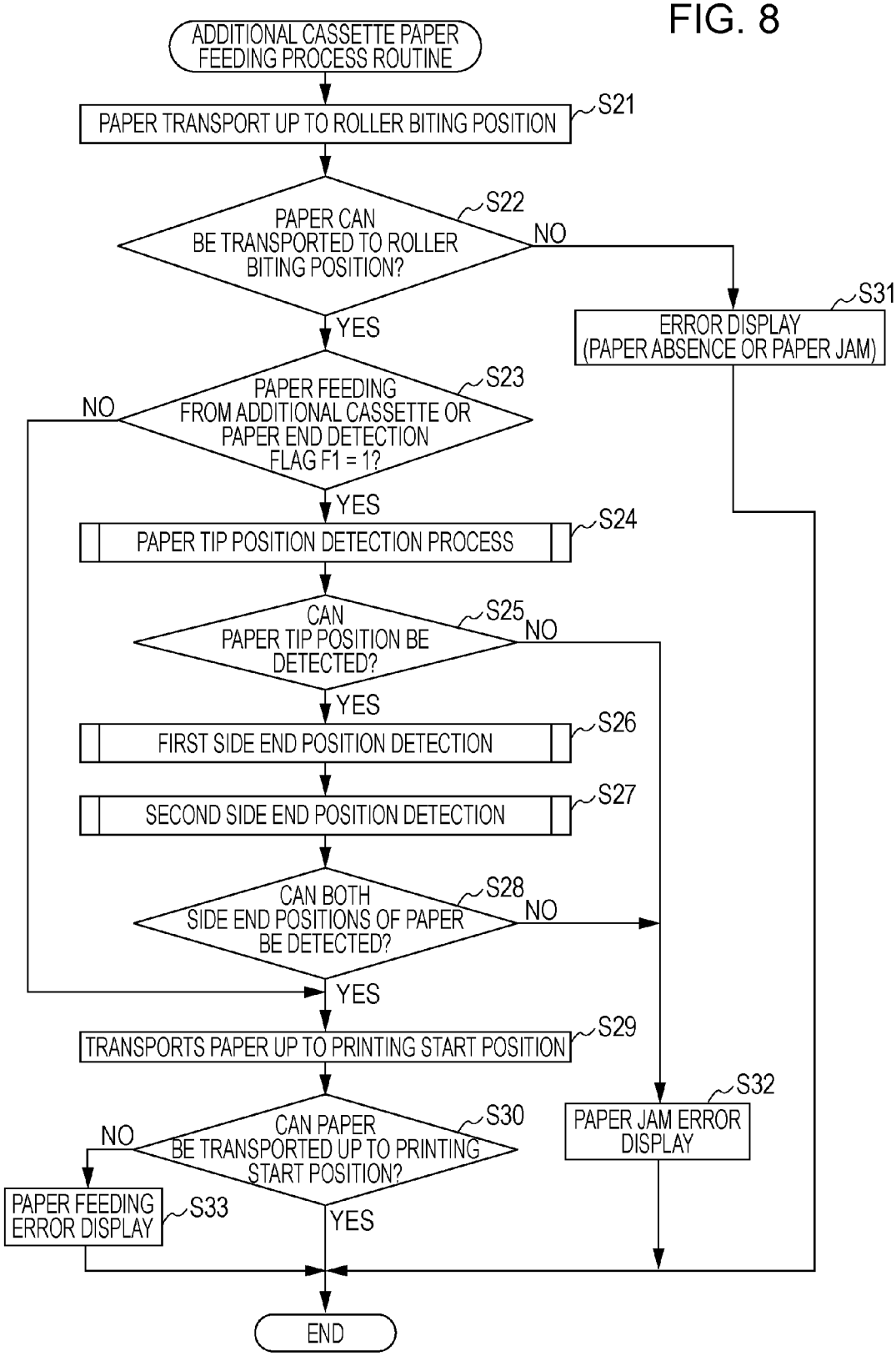
FIG. 8 is a flow chart that shows an additional cassette paper feeding process routine.

Firstly, in step S21 in FIG. 8, the paper is transported (fed) up to a roller nipping position. Herein, the roller biting position means that the paper P is fed up to a position where the tip of the paper P is pinched (nipped) by the transport roller pair 45 for the skewing of the paper, that is, a position (the roller biting position) where the transport roller pair 45 is bitten to the tip of the paper P.

Moreover, in next step S22, it is determined whether or not the paper can be transported to the roller biting position. Herein, after the PF counter 86 is reset when the tip of the paper P is detected by the paper detection sensor 51 while being fed up to the roller biting position, the transport position of the paper setting the detection position as the original point is counted by the PF counter 86. A distance between the paper detection sensor 51 and the transport roller pair 45 is known. For that reason, in step S22, it is determined whether or not the count value of the PF counter 86 reaches a value corresponding to a value of the roller biting position. Moreover, if the count value of the PF counter 86 reaches the value corresponding to the roller biting position, it is determined that the paper can be transported up to the roller biting position. Furthermore, despite the fact that the rotation amount or the driving time from the driving start time of the ASF motor 31 exceeds a threshold value that is set to a value longer than the rotation amount or the time required for transporting the tip of the paper to the roller biting position, in a case where the paper detection sensor 51 does not detect the tip of the paper P, it is determined that a feeding error is generated in which the paper cannot be transported up to the roller biting position. The determination of the feeding error is performed by the second determination portion 90. Moreover, when the paper can be transported up to the roller biting position, the process proceeds to step S23, and when the paper cannot be transported up to the roller biting position, the process proceeds to step S31.

Herein, a case where the paper cannot be transported up to the roller biting position includes the case of the paper absence where the paper is not accommodated in the additional cassette 19, and a case where the paper jam is generated in which the fed paper is jammed on the way. In step S31, an error display indicating the paper absence or the paper jam is performed on the display portion 25. The display process is performed by a display control portion 87 that receives the notification of the error determination result by the second determination portion 90. In addition, the paper transported up to the roller biting position forms a flexure at the tip portion side by the inversion of the transport roller pair 45, and the skew of the paper P is removed when the transport roller pair 45 is rotated in the forward direction again and the flexure is opened.

In step S23, it is determined whether or not the paper is fed from the additional cassette 19 and the paper end detection flag F1=1. Since the paper is the first page in the initial printing (the printing operation) after the power source is turned on (the power supply activation), the paper end detection flag, which is set after the power source is turned on, is in the state of F1=1. Furthermore, the paper is fed from the additional cassette 19. Thus, the determination condition in step S23 is established, the process proceeds to step S24. In addition, when the paper feeding cassette 16 other than the additional cassette 19 or the paper feeding tray 17 of the rear side is selected, when the paper end detection flag F1 is a value "0" obtainable after going through the process of step S26, the processes of the steps S25 to S28 are omitted, and the process proceeds to step S29.

In step S24, a paper tip position detection process is performed. That is, the carriage 13 is moved to a predetermined position near the center position Xc, and the paper is transported from the skewing completion position to a predetermined position where the tip exceeds the detection target position of the paper width detector 52 in the transport position while causing the carriage 53 to wait in the position. As a consequence, the tip of the paper P is detected by the paper width detector 52. The counted value of the PF counter 86 when being detected by the paper width detector 52 is acquired as the tip detection position. The paper tip detection position is used in the loading of the paper P.

In next step S25, it is determined whether or not the paper tip position can be detected. That is, despite the fact that the PF motor 32 is driven by a sufficient rotation amount or for a driving time so as to transport the paper P up to the detection target position of the paper width detector 52, it is determined whether or not the paper width detector 52 detects the position. When the paper tip position can be detected, the process proceeds to step S26, and when the paper tip position cannot be detected the process proceeds to step S32. Herein, the case where the paper tip position cannot be detected includes a case where the paper jam is generated while the paper is transported up to the detection target position of the paper width detector 52. For that reason, in step S32, the paper jam error is displayed on the display portion 25.

Figure 9:
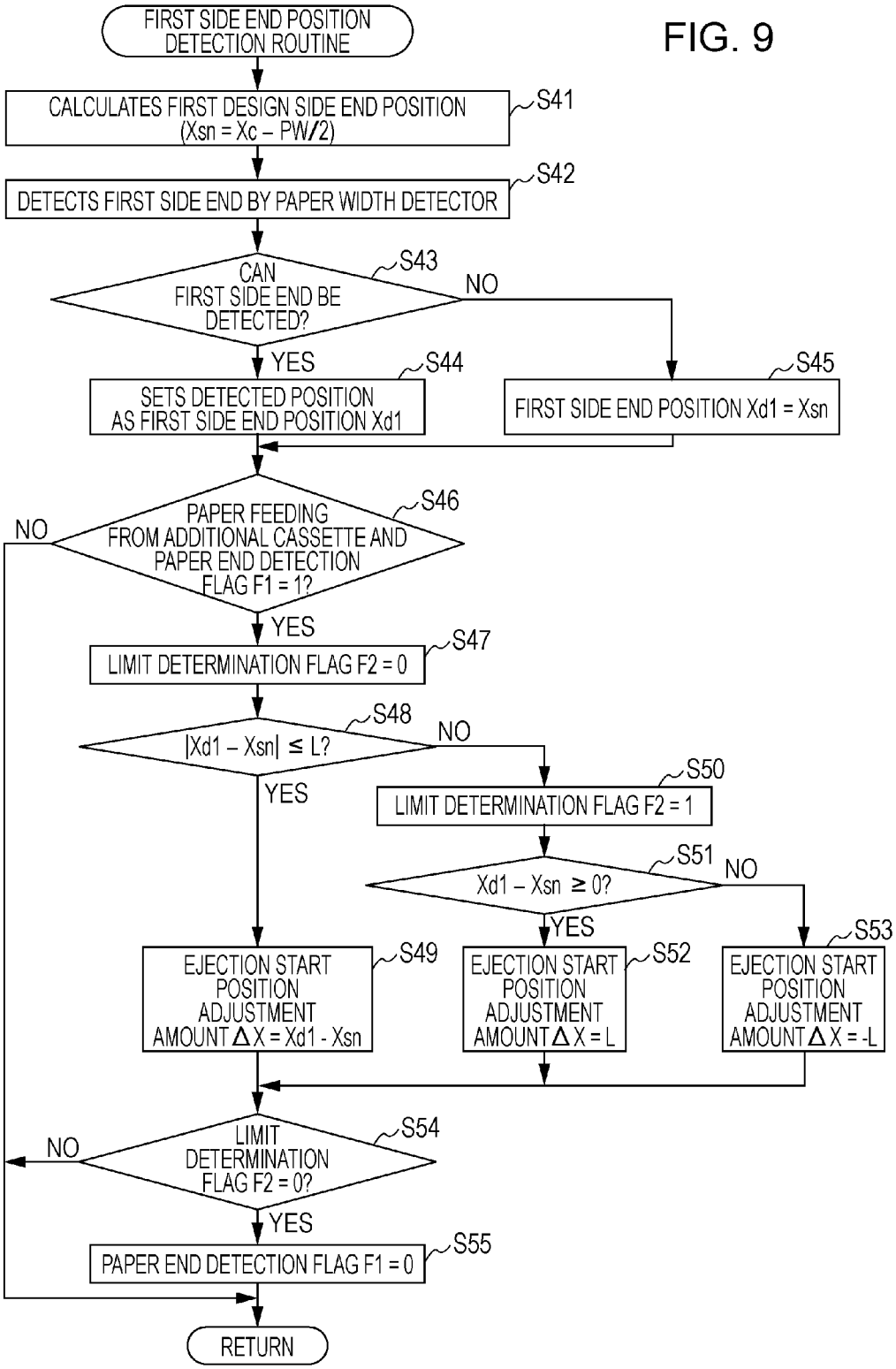
FIG. 9 is a flow chart that shows a first side end position detection process routine.

Meanwhile, when the paper tip position can be detected, in step S26, the first side end position detection process is performed. In the step S26, specifically, the first side end position detection process routine shown in FIG. 9 is performed. Hereinafter, the first side end position detection process will be described based on FIG. 9.

Firstly, in step S41, the first design side end position Xsn is calculated. That is, the calculation portion 88 calculates the first side end position Xsn by the formula Xsn=Xc−PW/2. Herein, Xc is a design center position (a width center position) of the paper in the width direction, and PW is a paper width. The paper width PW is obtained from information of the paper size, for example, with reference to the table.

In next step S42, the first side end of the paper is detected by the paper width detector 52. That is, the carriage 13 is moved from a predetermined position near the center during paper tip position detection process toward an object position near the home position HP. The object position is determined to a position where the paper width detector 52 can reliably pass through the first side end of the paper, depending on the paper size of that time. While the carriage 13 is moved up to the object position, the paper width detector 52 detects the first side end.

In next step S43, it is determined whether or not the first side end can be detected. When the first side end can be detected, the process proceeds to step S44, and when the detection is impossible, the process proceeds to step S45. Herein, a case where the paper width detector 52 cannot detect the first side end includes a case where the paper is abnormally significantly deviated in the width direction or a case where the paper width detector 52 cannot detect the reflected light from the paper P owing to the deep color of the paper.

When the first side end can be detected, in step S44, the detection position is set to the first side end position Xd1. Meanwhile, when the first side end cannot be detected, in step S45, the first design side end position Xsn is set as the first side end position Xd1. After the first side end position Xd1 is set in step S44 or S45, the process proceeds to step S46.

In step S46, it is determined whether or not the paper is fed from the additional cassette 19 and the paper end detection flag F1=1. Since the paper is the first page in the initial printing (the printing operation) after the power source is turned on (the power supply activation), the paper is fed in the paper end detection flag F1=1, which is set when the power source is turned on, from the additional cassette 19. Thus, since the determination condition in step S46 is established this time, the process proceeds to step S47. In addition, when the paper feeding cassette 16 other than the additional cassette 19 or the paper feeding tray 17 of the rear side is selected, or when the paper end detection flag F1 is a value "0" obtainable after finishing the process of step S49 in the routine, the routine is finished.

In step S47, the limit determination flag F2 is set to "0" (F2=0).

Moreover, in next step S48, it is determined whether or not |Xd1−Xsn|≤L. That is, the third determination portion 91 calculates an absolute value of a difference between the first side end position Xd1 and the first design side end position Xsn, that is, an absolute value of the deviation amount ΔX, and it is determined whether or not the absolute value is equal to or less than the limit value L. In other words, it is determined whether or not the deviation amount ΔX=Xd1−Xsn is within the scope of −L≤ΔX≤L. When the formula |Xd1−Xsn|≤L is established, the process proceeds to step s49, and when the formula is not established, the process proceeds to step S50.

In step S49, ΔX=Xd1−Xsn is set as the ejection starting position adjustment amount ΔX. That is, the deviation amount between the first side end position Xd1 and the first design side end position Xsn is set as the ejection starting position adjustment amount ΔX.

Meanwhile, in step S50, the limit determination flag F2 is set to "1" (F2=1). F2=1 means that |Xd1−Xsn| exceeds the limit value L. For example, when the paper set position in the additional cassette 19 deviates in the width direction, in some cases, |Xd1−Xsn| exceeds the limit value L. For this reason, in a case where there is a possibility that the deviation of the paper set position in the additional cassette 19 is a cause, the ejection starting position adjustment amount ΔX is limited to the limit value L.

For this reason, in step S51, it is determined whether or not Xd1−Xsn≥0 is established. By the determination of Xd1−Xsn≥0, it is determined whether the first detected side end position Xd1 deviates to a positive side (a counter home position side) (a condition establishment) or deviates to a negative side (a home position side) (a condition non-establishment), with respect to the first design side end position Xsn. When Xd1−Xsn≥0 is established, the process proceeds to step S52, and when Xd1−Xsn≥0 is not established, the process proceeds to step S53.

In step S52, ΔX=L is set as the ejection starting position adjustment amount ΔX. That is, the ejection starting position adjustment amount ΔX is limited to the limit value L.

Furthermore, in step S53, ΔX=−L is set as the ejection starting position adjustment amount ΔX. That is, the ejection starting position adjustment amount ΔX is limited to the limit value L.

Moreover, when the setting (the calculation) of the ejection starting position adjustment amount ΔX is finished, in step S54, it is determined whether or not the limit determination flag F2 is "0" (F2=0). If F2=0, the process proceeds to step S55, and the paper end detection flag F1 is set to "0" (F1=0). Meanwhile, if F2=1, the routine is finished. When F1=0, the resetting of the ejection starting position adjustment amount is not performed, and the ejection starting position adjustment amount ΔX set this time is used until the power source is turned off (the power source is blocked). Meanwhile, when F1=1, after the next time, the ejection starting position adjustment amount ΔX is reset. The first side end position detection process is finished as mentioned above.

Returning to FIG. 8, in next step S27, the second side end position detection process is performed. That is, the carriage 13 is moved from the position where the first side end position detection process is finished to the object position of the counter-home position side. The object position can be determined in the position where the paper width detector 52 can reliably pass through the second side end of the paper, depending on the paper size of that time. While the carriage 13 is moved up to the object position, the paper width detector 52 detects the second side end of the paper width detector 52.

In next step S28, it is determined whether or not both side end positions of the paper can be detected. When both side end positions of the paper can be detected, the process proceeds to step S29, and when both side end positions cannot be detected, the process proceeds to step S32. Herein, the case where both side end positions of the paper cannot be detected includes a case where the paper jam is generated. For this reason, in step S32, the error display indicating the paper jam is performed on the display portion 25.

Meanwhile in step S29, the paper is transported up to the printing starting position. That is, the loading of the paper is performed.

Moreover, in next step S30, it is determined whether or not the paper can be transported up to the printing starting position. When the paper can be transported up to the printing starting position, the routine is finished. Meanwhile, when the paper cannot be transported up to the printing starting position, the process proceeds to step S33, and the indication of the paper feeding error is displayed on the display portion 25.

In this manner, in the first page of the initial printing in the paper feeding from the additional cassette 19 after the power source is turned on, if the feeding error is not generated, the ejection starting position adjustment amount ΔX is set. In the ejection starting position adjustment amount ΔX, when $|Xd1-Xsn|\leq L$ is established, $\Delta X=Xd1-Xsn$ is set. Meanwhile, when $|Xd1-Xsn|\leq L$ is not established, $\Delta X=L$ or $\Delta X=-L$ is set. Moreover, when $\Delta X=Xd1-Xsn$ is set, the paper end detection flag is renewed to F1=0, but when $\Delta X=L$ or $\Delta X=-L$ is set, the paper end detection flag F1=1 is not renewed.

Figure 7:
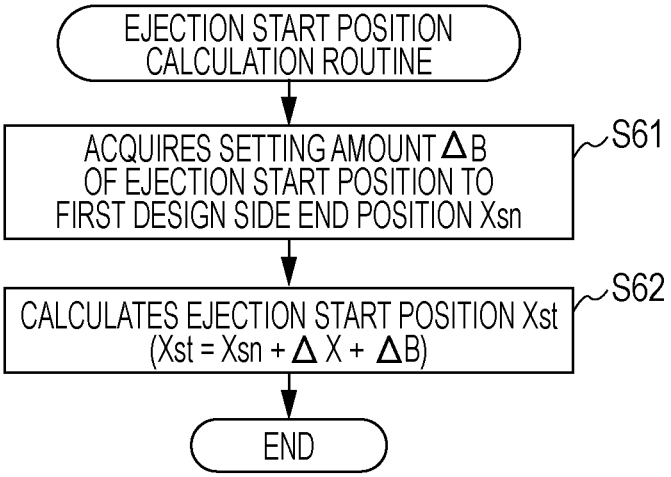
FIG. 7 is a flow chart that shows an ejection starting position calculation routine.

In this manner, when the ejection starting position adjustment amount ΔX is set, then, the computer 70 performs the ejection starting position calculation routine shown in FIG. 7.

Firstly, in step S61, a setting amount ΔB of the ejection starting position to the first design side end position Xsn is acquired. The setting amount ΔB is an adjustment value that is defined based on the layout information (the margin information of the width direction, presence or absence of the borderless printing or the like) of the printing set information. The setting amount ΔB is, for example, acquired as a piece of information in the header of the printing data calculated by the printer driver, or is acquired by the calculation of the calculation portion 88 on the basis of the layout information as a piece of information in the header of the printing data. The setting amount ΔB is given as the adjustment value from the side end position of the paper. For example, when a margin amount B mm of the width direction is set, the setting amount is given as a value in which the margin is ensured (for example, ΔB=B mm). When the borderless printing is set, the setting amount is given as a value of a predetermined distance G mm (for example, 1 to 3 mm) at the outside (the negative side) of the side end position so that the borderless printing is reliably performed (for example, ΔB=−G mm).

In next step S62, an ejection starting position Xst is calculated. That is, the ejection starting position Xst is calculated by formula $Xst=Xsn+\Delta X+\Delta B$. Before the paper is loaded to the printing starting position and the printing of first pass (first line) is started, the ejection starting position Xst is obtained. Moreover, in the process during which the carriage 13 is moved from the home position HP side by the first pass, when the nozzle row 22*b* reaches the carriage position that coincides with the ejection starting position Xst, an ejection permission signal is output which permits the ejection of the ink droplet from the control portion 71 to the head control portion 74. When the ejection permission signal is input, the head control portion 74 sends the ejection starting permission signal to the head driving circuit 66. When the ejection starting permission signal is input, the head driving circuit 66 starts the ejection control of the ink droplet of the recording head 22 based in the head control data.

In this manner, after that, the printing for each pass is repeated on the basis of the set ejection starting position Xst, and the printing on the paper P is performed. Herein, the printing method includes a one-way printing method of performing the printing only in a forward movement course in which the carriage 13 is moved from the home position side to the counter-home position side, and a bidirectional printing method of performing the printing even in a backward movement course in which the carriage 13 is moved from the counter-home position side to the home position side, in addition to the printing of the forward movement course, depending on the printing mode. In the case of the bidirectional printing method, the ejection starting position Xst of the forward movement course is calculated by formula $Xst=Xsn+PW+\Delta X-\Delta B$, for example, by the use of the first design side end position Xsn, the paper width PW, the ejection starting position adjustment amount ΔX, and the setting amount ΔB of the second side end position side. Of course, the ejection starting position Xst of the backward movement course may be calculated by the use of the second side end position Xd2 acquired in the second side end position detection process (S27).

In this manner, when the printing of a plurality of passes is performed by one-way printing method or the bidirectional printing method and the printing of the first page is finished, the printed paper P is discharged. Moreover, if a plurality of sheets is printed, the paper of the second page is fed from the additional cassette 19. During feeding, in the same manner as the first page, the additional cassette paper feeding process shown in FIGS. 8 and 9 is performed.

For example, in the paper feeding process of the first page, when the ejection starting position adjustment amount ΔX is set, since the paper end detection flag is F1=0, in step S23 in FIG. 8, the determination condition is not established in which the paper is fed from the additional cassette 19 and the paper end detection flag F1=1. For this reason, after performing the skewing (S21) in the feeding process, the paper end detection processes (S24 to S28) are omitted, and the paper is transported up to the printing starting position in step S29. That is, the resetting (S26) of the ejection starting position adjustment amount ΔX is not performed, and the ejection starting position adjustment amount ΔX is used which is set at the time of the feeding of the first page.

Meanwhile, in the paper feeding process of the first page, even if the ejection starting position adjustment amount ΔX is set, when that is the limit value ($\Delta X=L$ or $\Delta X=-L$), the paper end detection flag F1=1. Thus, in step S23 in the feeding course of the second page, the determination condition in which the paper is fed from the additional cassette 19 and the paper end detection flag F1=1. For this reason, in the feeding course of the second page, step S26 of FIG. 8, that is, the routine of FIG. 9 is performed again. Moreover, in step S48 of FIG. 9, if $|Xd1-Xsn|\leq L$ is established (the affirmation determination in S48), the ejection starting position adjustment amount $\Delta X=Xd1-Xsn$ is set in step S49. In this case, the paper end detection flag is renewed to F1=0 (S55).

Furthermore, even when the feeding error is generated in the first page, since the paper end detection flag is in the state of F1=1, the routine of FIG. 9 is performed in the re-feeding course of the first page after the feeding error is released. Moreover, in step S48 of FIG. 9, if $|Xd1-Xsn| \leq L$ is established (the affirmation determination in S48), the ejection starting position adjustment amount $\Delta X = Xd1 - Xsn$ is set in step S49. In this case, the paper end detection flag is renewed to F1=0 (S55). For example, when the feeding error is continued, in the re-feeding course when the feeding error is released, the routine of FIG. 9 is performed, and the routine is repeatedly performed in every feeding course until the ejection starting position adjustment amount $\Delta X$ ($=Xd1-Xsn$) is set.

Furthermore, when the paper set position in the additional cassette 19 deviates in the width direction, $|Xd1-Xsn| \leq L$ is not established, and the ejection starting position adjustment amount $\Delta X$ (=L or −L) is set, the routine of FIG. 9 is performed in every feeding course, and the routine is performed in every feeding course until the deviation of the paper set position is solved. Moreover, when the paper set position in the additional cassette 19 is correctly fixed, in the next additional cassette paper feeding process routine, the ejection starting position adjustment amount $\Delta X$ ($=Xd1-Xsn$) is set (S49).

In this manner, after the ejection starting position adjustment amount $\Delta X$ ($=Xd1-Xsn$) after the power source is turned off, the ejection starting position adjustment amount $\Delta X$ is adopted until the power source is turned off.

Furthermore, when the additional feeding device 18 is mounted after the power source is turned on, after the mounting of the feeding device 18 is detected by the additional detection sensor 67, when the paper feeding from the additional cassette 19 is firstly selected, the additional cassette paper feeding process routine shown in FIGS. 8 and 9 is performed. For this reason, even when the additional feeding device 18 is mounted after the power source is turned on, the ejection starting position adjustment amount $\Delta X$ is set, whereby the printing is performed in a suitable printing range in the width direction of the paper.

As mentioned above, in the present embodiment, the effects described below can be obtained.

(1) After the power source is turned on, the paper width detector 52 detects the first side end position Xd1 of the paper P fed from the feeding device 18 in the feeding course before the printing start. Moreover, the calculation portion 88 calculates the deviation amount $\Delta X$ between the first side end position Xd1 detected by the paper width detector 52 and the design (theoretical) side end position Xsn. The main control portion 81 (the adjustment unit) adjusts the limit position of the printing range in the width direction, in which the printing of the recording head 22 is permitted, by the use of the deviation amount $\Delta X$ (the adjustment amount). Thus, it is possible to suppress the deviation of the printing range to the paper P in the width direction due to the mounting deviation of the detachable feeding device 18.

(2) The paper width detector 52 detects the first side end position of the paper P that is fed from the feeding device 18 in the first page of the initial printing (the printing operation), after the feeding device 18 is mounted after the power source is turned on. Thus, during printing by the feeding from the detachable feeding device 18, it is possible to suppress the deviation of the printing range in the width direction from the first page of the initial printing.

(3) Both side end positions of the paper P in the width direction are detected by the paper width detector 52 provided in the carriage 13. The deviation amount $\Delta X$ is calculated by the use of at least the first side end position Xd1 of both side end positions detected at this time. Moreover, by the main control portion 81, the ejection starting position (the recording starting position) of the recording head 22 is adjusted which is moved together with the carriage 13 to perform the printing, by the use of the deviation amount $\Delta X$. Thus, in the serial type printer 11, the ejection starting position of the recording head 22 is adjusted, whereby it is possible to suppress the deviation of the printing range in the width direction of the paper P.

(4) When the feeding error of the paper P is detected before the adjustment by the main control portion 81, the first side end position Xd1 is detected in the next feeding course from the feeding device 18 after the feeding error is relived to acquire the deviation amount $\Delta X$, and the main control portion 81 adjusts the limit position of the printing range by the use of the acquired deviation amount $\Delta X$. Thus, even when the feeding error is generated, one of the first side end position Xd1, the deviation amount $\Delta X$, and the limit position of the recording range can be acquired, and, as a result, the ejection starting position (the limit position of the printing range) cannot be adjusted, in the next feeding course from the feeding device 18 after the feeding error is released, the adjustment amount of the ejection starting position is adjusted again. Thus, even when the feeding error is unexpectedly generated in the feeding when performing the adjustment process, it is possible to suppress the deviation of the recording range of the paper P in the width direction in the next printing.

(5) When it is determined that the deviation amount $|\Delta X|$ exceeds the limit value L (the limiting value) by the third determination portion 91, the main control portion 81 sets the limit value L as the ejection starting position adjustment amount $\Delta X$, and sets the ejection starting position Xst by the use of the ejection starting position adjustment amount $\Delta X$ (=L or −L). For example, even when an excessive deviation amount $\Delta X$ is calculated due to the fact that the paper P set position in the feeding device 18 deviates in the width direction, since the ejection starting position adjustment amount $\Delta X$ is limited to the limit value L, the position can be adjusted to a suitable ejection starting position. Thus, it is possible to avoid the deviation of the printing range to the paper P in the width direction due to the fact that the excessive ejection starting position adjustment amount $\Delta X$ is set according to the deviation of the paper P set positions in the additional cassette 19, then, the excessive ejection starting position adjustment amount $\Delta X$ is consecutively used, and is adjusted to the unsuitable ejection starting position Xst.

(6) After the ejection starting position adjustment amount $\Delta X$ is set by the main control portion 81, until the power source is turned off, the ejection starting position Xst (the limit position of the recording range) based on the ejection starting position adjustment amount $\Delta X$ is adopted, whereby the printing (the ink droplet ejection) is performed by the recording head 22. Thus, at every printing fed from the additional feeding device 18, there is no need to perform the process that includes the detection of the first side end position Xd1, the calculation of the ejection starting position adjustment amount $\Delta X$, and the adjustment of the ejection starting position Xst (the limit position of the recording range). As a consequence, for example, it is possible to improve the throughput of the printing at the time of the feeding from the additional feeding device 18.

(7) When the additional feeding device 18 is a center feeding type, the first side end position is changed depending on the paper sizes, but even if the paper sizes are different, it is possible to adjust the ejection starting position Xst (the limit position of the printing range) by the use of the same ejection starting adjustment amount ΔX. Thus, in any paper size, it is possible to suppress the deviation of the printing range to the paper P in the width direction due to the recording head 22.

(8) when the deviation amount |ΔX| exceeds the limit value L, since the ejection starting position adjustment amount ΔX=L or ΔX=−L is adopted, the suitable ejection starting position Xst can be adopted. If the paper P set position in the additional cassette 19 deviates in the width direction, it is possible to adopt the more suitable ejection starting position Xst to perform the suitable printing, and meanwhile, even if the paper P set position in the additional cassette 19 is correct and the mounting deviation of the feeding device 18 is a cause, it is possible to adopt the more suitable ejection starting position Xst to perform the suitable printing.

(9) when the deviation amount |ΔX| exceeds the limit value L, since the paper end detection flag F1 is not set to "0", until the deviation amount |ΔX| is equal to or less than the limit value L, the paper end detection processes (S24 to S28) are repeatedly performed. For this reason, if the paper P set position in the additional cassette 19 deviates in the width direction, until the set position is corrected, the paper end detection is performed every time, and the ejection starting position Xst is obtained by the use of the ejection starting position adjustment amount ΔX depending on the first side end position Xd1 of the paper P of that time. For this reason, it is possible to perform the printing from the more suitable ejection starting position Xst. Moreover, after the paper P set position in the additional cassette 19 is corrected, in the paper end detection of the first page of the printing by the paper feeding from the additional cassette 19, since the deviation amount |ΔX| is equal to or less than the limit value L, after that, the ejection starting position adjustment amount ΔX set at this time is adopted, whereby the printing can be performed from the suitable ejection starting position Xst.

In addition, the embodiment mentioned above can be changed in the form as below.

A configuration may be adopted which obtains the ejection starting position adjustment amount ΔX by adopting the second side end position Xd2. Furthermore, the standard position may be the design side end position of the counter-home position side, without being limited to the design side end position of the home position side. In addition, it may be possible to adopt the design side end positions of both of the home position side and the counter-home position side, that is, the first design side end position and the second design side end position. In this case, it is also possible to adopt a configuration in which each deviation amount acquired by the use of the respective design side end positions and the actually detected first side end position Xd1 and second side end position Xd2 are set to the adjustment amounts, respectively, and the recording starting position of the forward movement course and the recording starting position of the backward movement course are obtained by the use of the respective adjustment amounts.

Instead of the ejection starting position adjustment amount ΔX, a configuration may be adopted in which the ejection starting position Xst is obtained by the use of the first side end position Xsn after the correction, by setting the first side end position Xsn (=Xsn+ΔX) after the correction in which the first design side end position Xsn is added with the correction for each paper size.

When the deviation amount |ΔX| exceeds the limit value L, the ejection starting position adjustment amount ΔX is not set to the limit value L, but the ejection starting position adjustment amount ΔX may be set to ΔX=0.

By eliminating the determination whether or not the deviation amount |ΔX| is equal to or less than the limit value L, the limitation may be released by which the limit value L is set to the upper limit or the lower limit of the ejection starting position adjustment amount ΔX.

The paper width PW used in the process (S41) of calculating the first design side end position Xsn is obtained from the paper size, but the first design side end position Xsn may be calculated by the use of the paper width PW (=Xd2−Xd1) measured from the both side end positions detected by the paper width detector 52.

The additional feeding device 18 (that is, the additional cassette 19) is not limited to the center feeding type (a centering paper feeding type). For example, it may be possible to adopt a unilateral approach type in which a paper guide includes a fixing guide and an available guide, and the paper feeding is performed while guiding the paper in a position brought near to one side by brining one side end of the paper into contact with the fixing guide. In this manner, even in the case of the bilateral approach paper feeding type, it is possible to perform the more suitable printing from the ejection starting position (the recording starting position) where the mounting deviation of the case of mounting the additional feeding device 18 is adjusted.

The ejection starting position adjustment amount ΔX may be obtained whenever the printing is performed in which the paper is fed from the additional cassette 19, by abolishing the paper end detection flag F1. In this case, a configuration may be adopted which sets the ejection starting position adjustment amount ΔX in the initial first page for each printing operation, and a configuration may be adopted in which the ejection starting position adjustment amount ΔX is set for each page.

Instead of the paper end detection that detects the first side end and the second side end of the paper, a configuration may be adopted in which only one side end position required for the correction of the ejection starting position is detected.

The feeding error is not limited to the embodiment mentioned above. For example, the paper size (the recording medium size) may be detected based on the both side end positions detected by the paper width detector 52 (a medium width detection unit), and the detected paper size may be a feeding error different from the paper size of the printing set information. Moreover, in the case of the feeding error, a configuration may be adopted which resets the ejection starting position adjustment amount ΔX. According to the configuration, the paper size is detected based on the both side end positions detected by the paper width detector 52, in a case where the detected paper size is different from the set paper size, when the next paper is fed from the additional feeding device 18, the detection of the side end position, the calculation of the deviation amount |ΔX| (that is, the ejection starting position adjustment amount ΔX), and the adjustment of the ejection starting position Xst are performed again. Thus, even when the paper size of the printing setting does not coincide with the actual paper size and this kind of feeding error is generated, since the ejection starting position Xst (the limit position of the recording range) is adjusted again, it is possible to perform the printing on the paper in the suitable printing range in the width direction.

The respective functional portions of the control portion 71 in the computer 70 in FIG. 5 were realized mainly by software by the CPU executing the program. However, the respective functional portions may be realized by hardware by an integrated circuit such as ASIC or may be realized by the cooperation between the software and the hardware.

The recording apparatus may be a lateral type printer, a line printer, and a page printer, without being limited to the serial printer. Furthermore, the recording apparatus can also be applied to a dot impact type recording apparatus without being limited to the ink jet type. In summary, the invention can widely be applied to a recording apparatus which can detachably mount the feeding device on the recording apparatus main body and has a configuration in which the limit position of the recording range in the recording medium in the width direction deviates due to the mounting deviation when mounting the feeding device on the main body, despite the fact that the paper is set in the feeding cassette in the correct position in the width direction. For example, in the case of the line printer, a line sensor extended in the width direction is provided as the detection unit, and the side end position of the paper is detected by the line sensor. Moreover, when implementing the additional feeding device, the deviation amount between the design side end position and the detected side end position due to the mounting deviation of the feeding device to the printer main body are set as the adjustment amount. In addition, a configuration is adopted which adjusts the limit position of the recording range (the ink ejection range) in which the recording by the line type recording head is permitted by the use of the adjustment amount.

In the embodiment mentioned above, the ink jet type printer 11 is adopted as the recording apparatus, but a fluid ejecting device may be adopted which ejects or discharges another fluid other than ink. Furthermore, the invention can be used in various liquid ejecting devices that include a liquid ejection head or the like which discharges a minute amount of liquid droplet. In this case, the liquid droplet refers to a liquid state discharged from the liquid ejecting device, and also includes matter leaving traces in a gradual shape, a tear shape and a filiform. Furthermore, liquid mentioned herein may be a material that can be ejected by the liquid ejecting device. For example, the matter of a condition when the substance is a liquid phase may be used, and liquid having high or low viscosity, sol, gel water, other inorganic solvent, organic solvent, solution, liquid resin, a flow-like body such as a liquid metal (metallic melt), liquid as one state of a substance, as well as matter in which particles of the functional material formed of solid matter such as pigment or metallic particle are solved, dispersed, or mixed in the solvent or the like are included. Furthermore, as a typical example of the liquid, ink, liquid crystal or the like as described in the embodiment mentioned above are included. Herein, ink includes various liquid compositions such as general water-based ink, oil-based ink, gel ink, and hot-melt ink. As a specific example of the liquid ejecting device, for example, it is possible to adopt a liquid crystal display, an EL (electroluminescence) display, a plane emission display, a liquid ejecting device which ejects liquid containing the material such as an electrode material or a color material used in the manufacturing of the color filter or the like in the form of the dispersion or the dissolution. In addition, the liquid ejecting device may be a liquid ejecting device that ejects living body organic matter used in manufacturing a bio chip, a liquid ejecting device that is used as a precision pipette and ejects liquid becoming a sample, a printing device, a micro dispenser or the like. In addition, it may be possible to adopt a liquid ejecting device that ejects lubricant oil to precision machine such as a watch or a camera by a pinpoint, a liquid ejecting device that ejects transparent resin liquid such as ultraviolet curing resin for forming a micro hemispherical lens (an optical lens) used in an optical communication element or the like onto a substrate, and a liquid ejecting device that ejects etching liquid such as acid or alkali for etching the substrate or the like. Moreover, the invention can be applied to any one kind of liquid ejecting device among them. Furthermore, the fluid may be particulate matter such as a toner. In addition, the fluid described in the specification does not include matter formed only of gas.

What is claimed is:

1. A recording apparatus on which a feeding device is detachably mounted for feeding a recording medium, the apparatus comprising:

a transport unit that transports the recording medium;

a recording unit that records the recording medium;

an acquisition unit that acquires a theoretical side end position in a width direction intersecting with a transport direction of the recording medium;

a detection unit that detects a side end position of the recording medium which is fed from the feeding device;

a calculation unit that calculates a deviation amount between the side end position detected by the detection unit and the theoretical side end position as an adjustment amount; and an adjustment unit that adjusts a recording range of the recording unit by the use of the adjustment amount, wherein the adjustment unit adjusts the recording range in a first page of an initial recording after at least the feeding device is mounted.

2. The recording apparatus according to claim 1, wherein the recording unit is a carriage which has a recording head and is able to be moved in the width direction, the detection unit includes a medium width detection unit which is provided in the carriage and is able to detect both side end positions of the recording medium in the width direction by the movement of the carriage, the detection unit moves the carriage before the recording starting in the feeding course from the feeding device to detect both side end positions by the medium width detection unit, and the adjustment unit adjusts the recording starting position of the recording head which is moved together with the carriage by the use of the adjustment amount to perform the recording.

3. The recording apparatus according to claim 1, further comprising:

an error detection unit which detects a feeding error of the recording medium, wherein, when the feeding error of the recording medium is detected before the adjustment by the adjustment unit, the side end position is detected in the next feeding course from the feeding device after the feeding error is released, and the adjustment unit adjusts the recording range by the use of the acquired adjustment amount.

4. The recording apparatus according to claim 1, further comprising:

a determination unit that determines whether or not a deviation amount exceeds the limit value, wherein the adjustment unit limits the adjustment amount to the limit value when it is determined that the deviation amount exceeds the limit value.

5. The recording apparatus according to claim 1, wherein, after the recording range is adjusted by the adjustment unit, until a power source is cut off, the recording by the recording unit is performed based on the adjusted recording range.

6. The recording apparatus according to claim 1, wherein the feeding device is a center feeding type that guides the recording medium near the center.

7. A recording method in a recording apparatus on which a feeding device is detachably mounted for feeding a recording medium, the method comprising:

detecting a side end position in a width direction intersecting with a transport direction of the recording medium which is fed from the feeding device;

calculating a deviation amount between the side end position detected during the detecting of the side end position and a theoretical side end position as an adjustment amount; and adjusting a recording range of the recording unit by the use of the adjustment amount, wherein, in the adjusting of the recording range, the recording range is adjusted in a first page of an initial recording after at least the feeding device is mounted.

* * * * *